US005913651A

United States Patent [19]

Erfgen et al.

[11] Patent Number: 5,913,651

[45] Date of Patent: Jun. 22, 1999

[54] METHOD OF MANUFACTURING AN EASILY-OPENED CAN LID, AND EASILY-OPENED CAN LID

[75] Inventors: Werner Erfgen, Melsbach; Reiner Sauer, Neuwied, both of Germany

[73] Assignee: Rasselstein Hoesch GmbH, Neuwied, Germany

[21] Appl. No.: 08/859,650

[22] Filed: May 20, 1997

[30] Foreign Application Priority Data

May 21, 1996 [DE] Germany ..... 296 09 130 U

[51] Int. Cl.[6] ..... B21D 51/44

[52] U.S. Cl. ..... 413/12; 413/8; 413/14

[58] Field of Search ..... 413/12, 14, 8, 413/62, 63

[56] References Cited

U.S. PATENT DOCUMENTS

| | | | |
|---|---|---|---|
| 161,634 | 4/1875 | Patterson | 413/8 X |
| 1,743,544 | 1/1930 | Helberg | 413/12 |
| 1,866,469 | 7/1932 | Hirsch et al. | 413/12 |
| 5,020,955 | 6/1991 | Zumsteg | 413/8 |
| 5,156,511 | 10/1992 | De Smet | 413/8 |

FOREIGN PATENT DOCUMENTS

| | | | |
|---|---|---|---|
| 28 38 505 | 12/1979 | Germany . | |
| 28072 | 10/1932 | Netherlands | 413/8 |

*Primary Examiner*—James F. Coan
*Attorney, Agent, or Firm*—Flynn, Thiel, Boutell & Tanis, P.C.

[57] ABSTRACT

A method of manufacturing an easy-opened lid from sheet metal is disclosed, wherein an opening is stamped in the lid and the stamped out portion is utilized in manufacturing the lid, thus reducing loss of lid material.

8 Claims, 5 Drawing Sheets

METHOD OF MANUFACTURING AN EASILY-OPENED CAN LID, AND EASILY-OPENED CAN LID

FIELD OF THE INVENTION

The invention relates to a method of manufacturing an easily-opened can lid from a coated sheet metal blank. The invention also relates to an easily-opened can lid made of sheet metal.

BACKGROUND OF THE INVENTION

Such can lids with which the invention is concerned, comprise a cover ring, which is produced by deep-drawing and stamping from a coated sheet metal blank, made e.g. of tinplate, chromed plate or aluminium. Provided on the outer edge of the cover ring is an external rim for later formation of a double seam, and the inner edge of the cover ring has an annular flange formed by a flat-pressed rolling, which surrounds a lid opening. A tear-off portion closing the lid opening is attached by heat-sealing to the annular flange. In such can lids, the opening extends over the entire surface surrounded by the relatively narrow cover ring. In this way, after the tear-off portion, usually formed by an aluminium foil, is peeled off, similarly to a full tear-off lid, a relatively large container opening is provided, so that the contents of the can are easily accessible. The rolling of the inner edge of the cover ring is intended to remove the risk of injury and also to contribute to increased rigidity of the can lid. Due to the external rim, such can lids can be extremely reliably connected to the can body by a double seam, and the tear-off foil ensures simple opening of the lid by peeling off the tear-off portion which is connected to the cover ring by heat-sealing. Such an easily-opened can lid and a method for its manufacture are described in DE 28 38 505.

In this known method of manufacturing an easily-opened can lid from a lacquered sheet metal blank, firstly a groove, corresponding to the ring contour of the cover ring, and comprising a groove base and two groove walls, is shaped by a first deep-drawing process in the blank, an outer rim on the one hand being formed at the edge of the blank for later formation of a double seam, and on the other hand a flat indentation being formed, surrounded by the outer rim. This flat indentation consists of a wall portion, i.e. the inner groove wall and a base portion surrounded thereby. The wall portion extends substantially vertically to the base portion. An opening is then stamped in this base portion in such a way that the cut edge by means of which this opening is formed extends at a certain spacing from the wall portion or the inner groove wall. In this way it is intended to form an annular leg forming a collar from the groove wall, and which extends from the groove wall to the cut edge. Stamping of the opening gives rise to a circular sheet metal disc as waste. The annular leg is then aligned straight, i.e. is bent upwards into the plane of the inner groove wall, and a groove-like shaping is introduced thereon in the groove base by deep-drawing, then the portion formed from the inner groove wall and the annular leg is bent upwards and outwards by further widening as far as the groove base, and pressed on to the groove base. This forms, inside the cover ring, an inner opening surrounded by a hollow lateral bead, whose diameter roughly corresponds to that of the previously-formed inner wall. The round sheet metal disc resulting during stamping of the original opening from the base portion has a diameter which is still substantially smaller than that of the final opening. As, in previously-known can lids, this cannot be further used, the stamped-out discs can only be re-used as scrap. As the area of the stamped-out disc as a rule comes to more than half of the area of the original sheet metal blank, the loss of material is extremely high. In addition, in order to close the final lid opening, a separate aluminium foil is required, which must be coated with a layer which is capable of heat-sealing. In order to save material, this foil is frequently extremely thin, so that there is a risk that said foil may be accidentally pierced.

The object of the invention is therefore to indicate a method of manufacturing an easily-opened can lid from a sheet metal blank, which enables re-use of the sheet metal part resulting when the opening is stamped, and thus reducing loss of material to a minimum. The further object of the invention is to provide an easily-opened can lid of the type already mentioned, likewise with the aid of enabling re-use of the stamped-out sheet metal part and reducing loss of material.

SUMMARY OF THE INVENTION

The method of manufacturing an easily-opened can lid from a coated sheet metal blank according to the invention comprises the following steps:

deep-drawing a blank provided on one side with a coating capable of heat-sealing, in order to form an outer rim at the edge of the blank for later formation of a double seam, and in order to form a flat indentation surrounded by the outer rim, with a base portion and a wall portion connecting the latter with the outer rim, said wall portion extending substantially vertically to the base portion, stamping out substantially the entire base portion in the direct vicinity of its transition to the wall portion, in order to form a cover ring whose inner cut edge, resulting from stamping, surrounds an opening, partial rolling of the wall portion in an outward direction in order to form a roll curl whose inner limit surrounds a smaller opening similar to the original opening formed by the stamping, in order to introduce a mutual overlapping of the lateral area of the previously stamped base part with the roll curl, at which the cut edge bears on the outer side of the cover ring, pressing flat the roll curl into the plane of the cover ring, or a plane parallel thereto, in order to form an annular flange suitable for heat-sealing, and in order to enlarge the overlapping, and heat-sealing the stamped out base portion on to the surface of the annular flange lying on the outer side of the cover ring, during flat pressing or after flat pressing of the roll curl.

Proceeding from the easily-opened can lid already mentioned, the can lid according to the invention is characterised in that the cover ring is produced from a sheet metal blank provided on one side with a coating capable of heat-sealing, in that the tear-off portion is formed by the stamped-out sheet metal portion, and in that the roll curl shaping is so formed and pressed flat that the can opening is smaller than the stamped-out sheet metal portion whose lateral area and the annular flange mutually overlap.

Thus the invention proceeds from the idea of re-using the sheet metal portion resulting from stamping of the opening from the blank as a tear-off portion, and attaching it to the annular flange of the cover ring by heat-sealing. In order to achieve this, on the one hand a sheet metal blank provided with a coating capable of heat-sealing must be used as an initial material, and on the other hand, the originally stamped-out opening must be reduced by appropriate shaping of the cover ring, in order to achieve an overlap of the sheet metal part stamped out in order to form the opening with the annular flange. To this end a portion of the wall portion of the indentation is rolled outwards and, by means of appropriate shaping by the deforming tools, it is ensured that the roll curl, even before being pressed flat and also thereafter, delimits an opening which is smaller than the original opening formed by stamping.

The invention achieves a situation in which the base portion stamped out of the blank in order to form the opening can be re-used in order to close the opening. In this way the loss of material is reduced to a minimum and also an additional aluminium foil provided with a coating capable of heat-sealing is eliminated. With corresponding design of the stamping and shaping steps and if necessary also of the transfer tools, during manufacture of the can lid the stamped-out base portion can remain permanently connected to the associated cover ring and is also held in precise position relative thereto, so that at the end of manufacture of the lid, the base portion may again be connected to the cover ring by heat-sealing. In this respect it is important that the metal blank or the sheet metal from which the metal blank is stamped has on at least one side a coating capable of heat-sealing. This coating can for example be a film of polypropylene or polyethylene terephthalate, or also a sealable organic lacquer. This coating is located on the inner side of the sheet metal blank or of the later lid, i.e, on that side facing the interior of the can when the lid is finished, this being carried out at the beginning of manufacture of the lid. By means of the shaping procedure, the heat-sealable coating is applied in the region of the roll curl and by pressing the latter flat in the area of the annular flange, to the outer side of the lid. As in the stamped-out base portion the heat-sealable coating is located on the later inner side of the lid or of the base portion, during heat-sealing two heat-sealable coatings come together, ensuring a pressure-tight seal.

Advantageous developments of the invention are featured in the sub-claims.

BRIEF DESCRIPTION OF THE DRAWINGS

The invention will be explained in more detail in the following with reference to embodiments shown in the drawings. Shown are.

Figure 3:
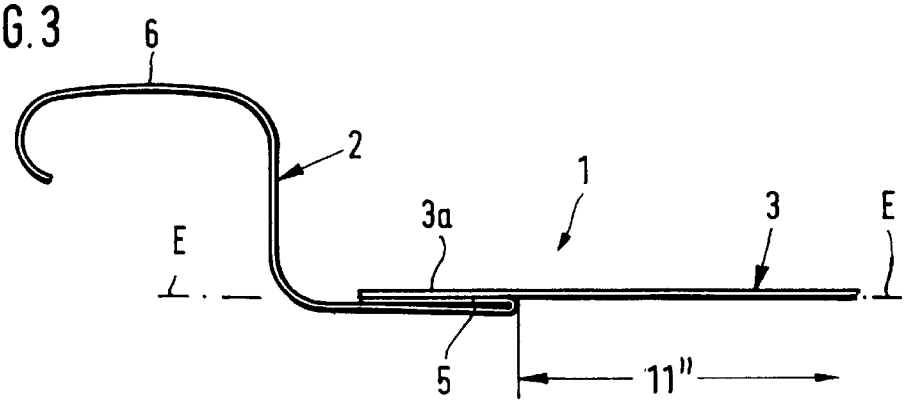
Figure 6:
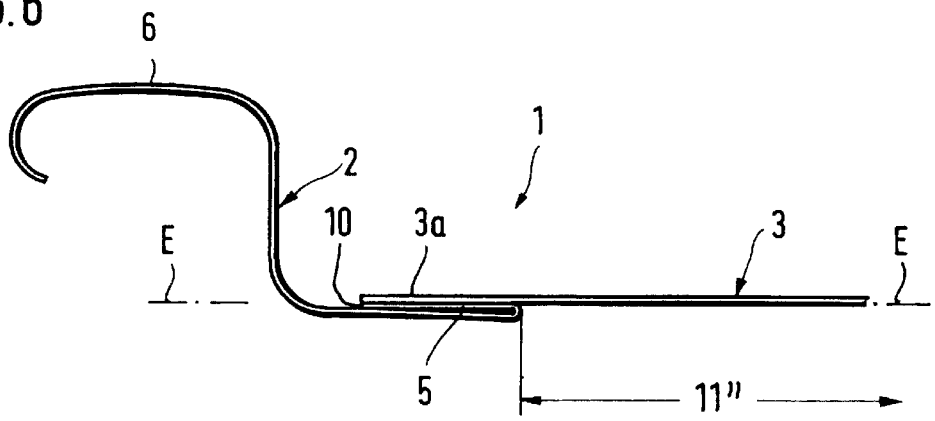
Figure 7:
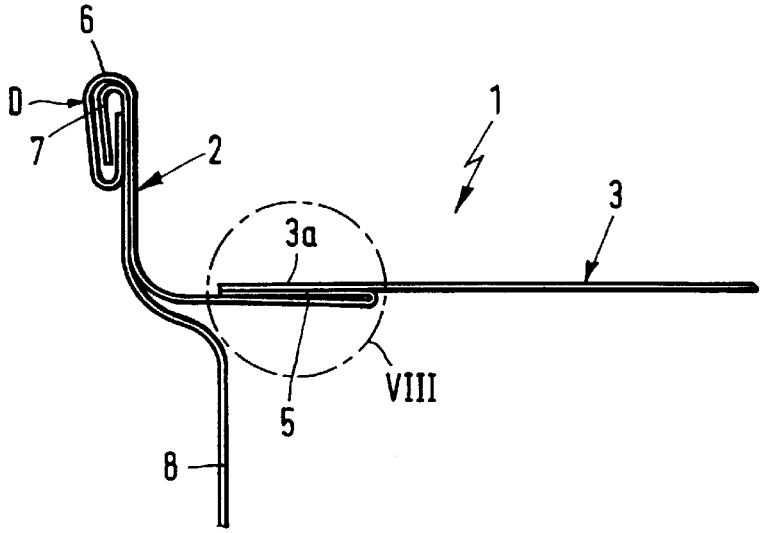
FIG. 7: a partial cross-section of a lid according to the invention connected to a can.
Figure 8:
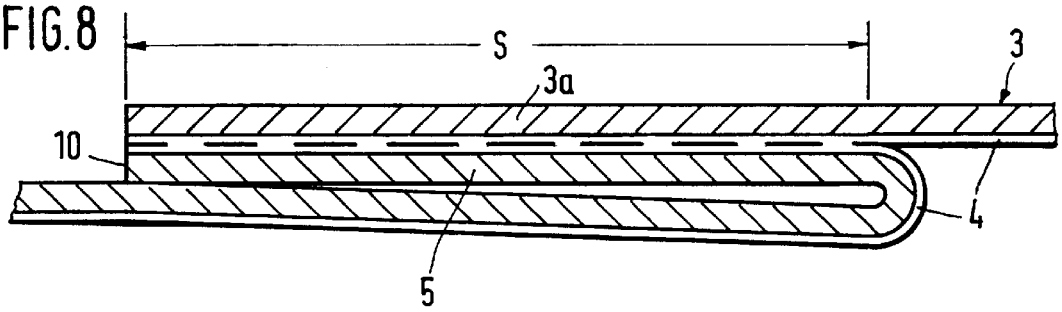
FIG. 8: an enlarged view of the area indicated by VIII in FIG. 7, FIG. 9: a plan view of a can with a first embodiment of an opening ring.
Figure 9:
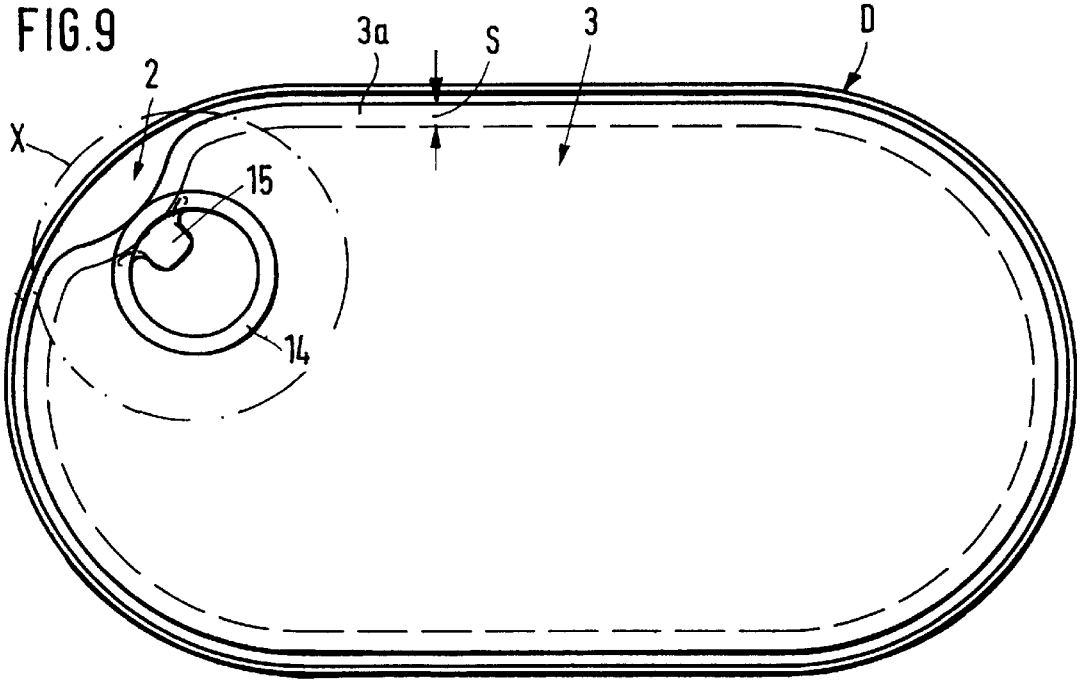
Figure 10:
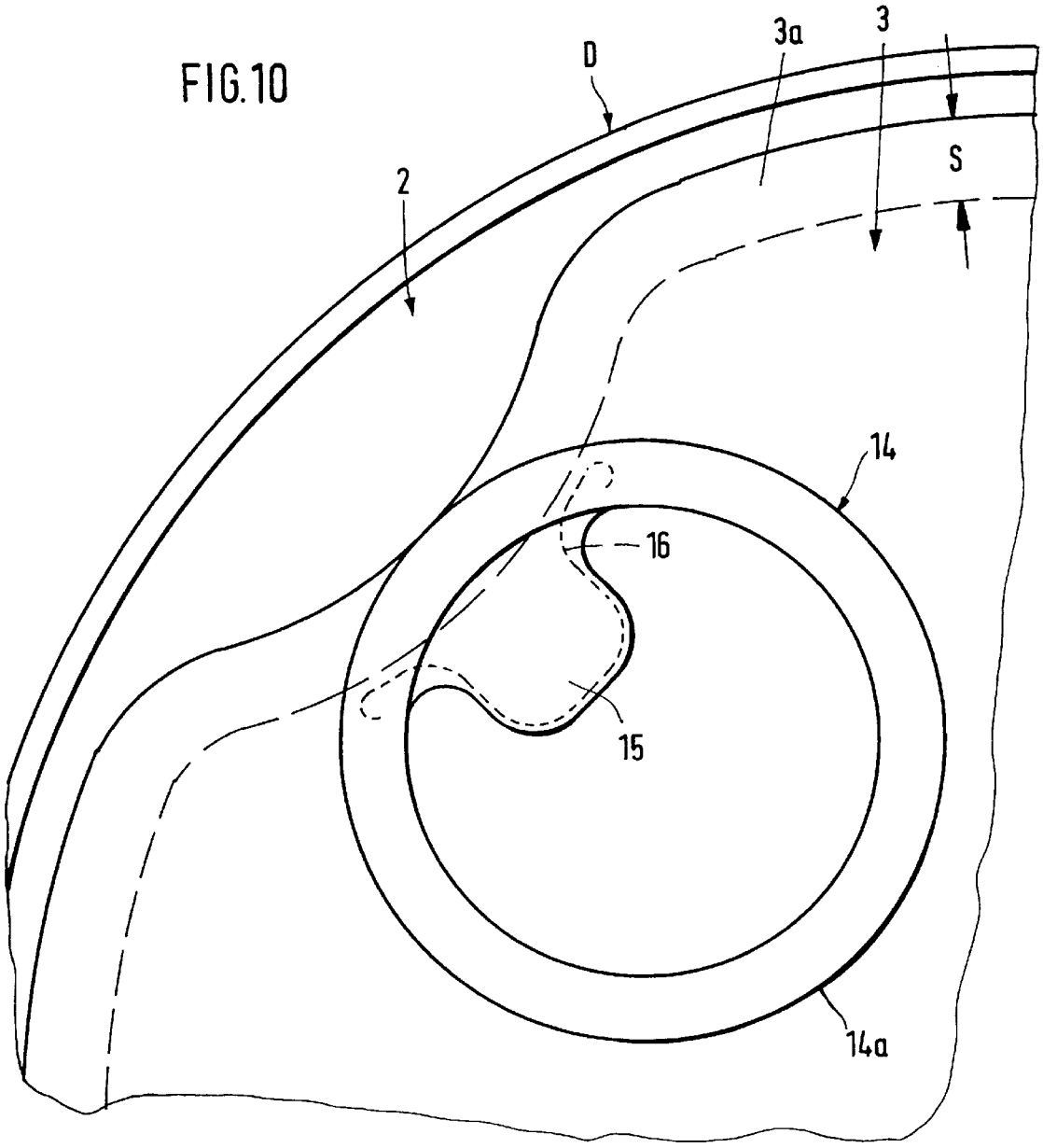
FIG. 10: an enlarged view of the area indicated by X in FIG. 9, FIG. 11: a plan view of a can with a second embodiment of the opening ring.

The finished, easily-opened can lid is shown in FIGS. 3 and 6 in respective partial cross-sections, this cross-section showing the lateral area of the can lid 1. This can lid 1 comprises a cover ring 2 and a tear-off portion 3. This tear-off portion 3, as described in more detail later, is formed in the can lid 1 according to the invention by a base portion, which occurs during manufacture of the cover ring 2. Both the cover ring 2 and the base portion 3 which are manufactured from the same sheet metal blank have, on their inner side (this is the side in the finished can facing the can body, and shown lying below in the drawings), a heat-sealable portion 4, which is only shown in FIG. 8. This coating can be a lining film of polypropylene, polyethylene terphthalate, a sealable lacquer or the like. The base portion 3 is sealed on to the annular flange 5 of the cover ring 2. The cover ring 2 also has an outer rim 6, which, together with a corresponding outer rim 7 of the can body 8, serves to form a double seam, as shown in FIG. 7.

In the following a first method of manufacturing the can lid 1 is described with references to FIGS. 1 to 3:

In order to manufacture the can lid, a sheet metal is used, e.g. tinplate, chromed thin plate or aluminium plate with a thickness of 0.05 and 0.3 mm. On one side, which will later be termed the inner side, and which in the finished can faces the interior of the can, this sheet metal has a heat-sealable coating 4 of an organic material, as already mentioned above. The sheet metal can be lacquered on its opposite outer side. Firstly a sheet metal blank (not shown) is stamped out of the sheet metal. By means of deep-drawing this sheet metal blank, according to FIG. 1 the outer rim 6 is pre-formed, and in addition a flat indentation N, surrounded by the outer rim, and which comprises a base portion 3 and a wall portion 5. In the flat indentation N the base portion is connected to the outer rim by the wall portion 9. The wall portion 9 extends substantially vertically to the base portion 3, or also vertically to the later lid plane E—E. The coating 4 (not shown) is located according to FIG. 1 on the downwardly-facing side of the outer rim 6 of the side directed to the left of the wall portion 9, and the side facing downwards of the base portion 3. Following the actual deep-drawing process, the base portion 3, as likewise shown in FIG. 1, is stamped out of the indentation in the direct vicinity of its transition to the wall portion 9, appropriately so that it is stamped out in an upward direction according to FIG. 1. In this way the cover ring 2 is pre-formed, an inner cut edge 10 resulting on the cover ring 2, said cut edge surrounding the opening 11 resulting from stamping of the base portion 3.

As the stamped-out base portion 3 is intended to be connected again to the cover ring 2 after further shaping steps, it is important that both parts do not move apart from one another during further transport into the transfer shaping tools. For this reason stamping of the base portion 3 should not be effected along a continuous cut edge 10; a few narrow connected webs, e.g. two to four, should be left during stamping between the base portion 3 and the wall portion 9. These connecting webs however are not shown in the drawing.

After the base portion 3 has been stamped out, a part of the wall portion 9, i.e. part of its overall height, is rolled outwards, i.e. towards the later outer side of the lid, or according to FIG. 2 in an upward direction. In this way a roll curl 19 is formed. During formation of the roll curl 19 care must be taken that the original opening 11 is reduced, so that the inner limit 19*a* of the roll curl 19 surrounds a smaller opening 11' similar to the original opening formed by stamping. This desired formation of the roll curl 19 in order to reduce the original opening 11 into a smaller opening 11' is effected by corresponding design of the shaping tools. By means of reduction of the original opening 11 to a smaller similar opening 11', mutual overlap is produced of the lateral area 3*a* of the base portion 3 with the roll curl 19. As can further be seen from FIG. 2, by rolling a portion of the wall portion 9, the cut edge 10 is brought up to the outer side of the cover ring 2. Here also by outer side is meant the outer side of the final can lid.

The roll curl 19 is then pressed flat into the plane E—E of the cover ring, or if necessary into a plane parallel thereto. In this way the annular flange 5 suitable for heat-sealing is formed, and also the overlap of the lateral area 3*a* of the base portion 3 with the annular flange 5 is made as large as possible. While the roll curl 19 is pressed flat, the opening 11' is further reduced, and then the final opening 11" results.

Finally, the lateral area 3*a* of the base portion 3 is connected in a pressure-tight manner by heat-sealing with the surface of the annular flange 5 lying on the outer side of the cover ring. As can be seen from FIG. 8, by means of rolling the wall portion 9 outwards and pressing the roll curl 19 flat, the original heat-sealable coating lying on the underside of the sheet metal blank or on the inner side of the cover ring 2 comes to rest outwards in the region of the annular flange 5. The heat-sealable coating 4 of the base portion 3 is then sealed on to this outwardly-directed portion 4*a* of the coating 4. This ensures a particularly good and pressure-tight seal between the cover ring 2 and base portion 3.

Figure 4:
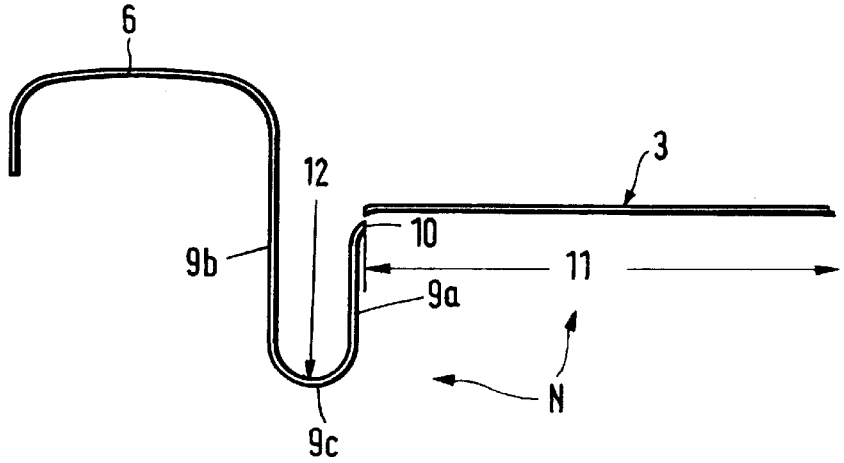
FIGS. 4 to 6: a second type of manufacturing process.
Figure 5:
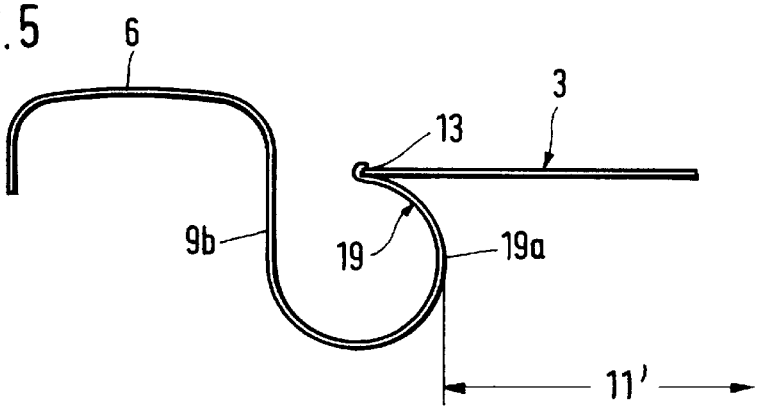

Another method of deep-drawing and stamping a sheet metal blank in order to produce the can lid is shown in FIGS. 4 to 6. In order to avoid repetitions, parts with identical functions are supplied with the same reference numbers as in FIGS. 1 to 3. The description previously given also logically relates to the method of manufacturing the can lid shown in FIGS. 4 to 6. According to FIG. 4, however in order to form the now downwardly-open flat indentation 1 by deep-drawing adjacent to the outer rim 6 of the later outer side of the lid, a groove 12 with a substantially U-shaped cross-section is shaped in the sheet metal blank. This groove 12 has an outer wall portion 9*b* immediately adjoining the outer rim 6, and an inner wall portion 9*a* adjoining the base portion 3. These two wall portions 9*a* and 9*b* after deep-drawing extend substantially vertically to the later lid plane E—E. They are connected together by the arc-shaped connector piece 9*c*.

After termination of the deep-drawing procedure, the base portion 3 is stamped out in an upward direction in the direct vicinity of its transition to the inner wall portion 9*a,* as shown in FIG. 4. Here also during stamping some small webs for mutual connection of base portion 3 and wall portion 9*a* should be left, so that during further transport in the tool, the base portion 3 does not move away from the cover ring 2.

The inner wall portion 9*a* is then rolled, in order to form the roll curl 19, and at the same time to reduce the original opening 11 to a smaller, similar opening 11'. In this case a modification of the roll curl can be effected, a small retaining groove 13 being shaped adjacent to the cut edge 10 and open towards the opening 11'. This retaining groove 13, similarly to the narrow webs, serves to hold the stamped-out base portion 3 during further transport into the transfer shaping tools, so that the base portion 3 does not move away from the cover ring 2.

The roll curl 19 is then pressed flat in the way described before, and for the purpose described before. Finally the base portion 3 is sealed on to the flange ring 5.

Figure 1:
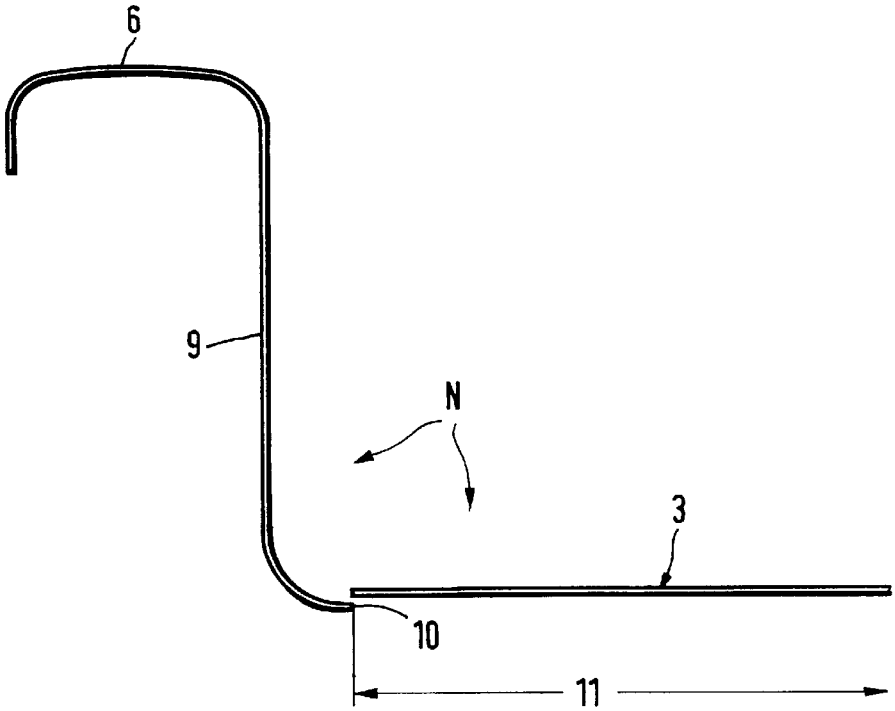
FIGS. 1 to 3: the individual process steps in a first type of manufacture of the easily-opened can lid respectively in partial cross-sections.
Figure 2:
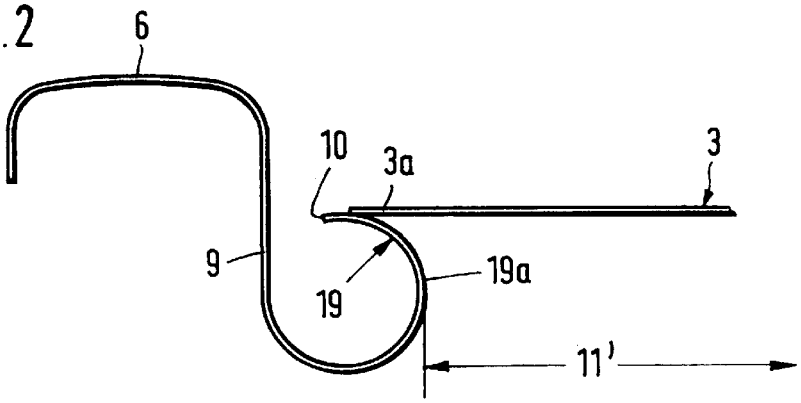

Both in the manufacturing method according to FIGS. 1 to 3 and also in the second manufacturing method according to FIGS. 4 to 6, the procedure can be such that, proceeding from the condition shown in FIGS. 2 to 5, the roll curl 19 is simultaneously pressed flat by means of the sealing tool, in order to produce the seal in the final position according to FIG. 3 or 6.

As can be seen from FIGS. 1 and 4, before rolling, the base portion 3 is offset relative to the cut edge 10 in an outward direction, i.e. towards the outer side of the lid. This offsetting is appropriately effected by the stamping tool. The offsetting is necessary because during rolling the opening 11 is reduced, and the base portion 3 could then no longer pass out through the opening.

By means of the mutual overlap of the lateral area 3*a* of the base portion 3 and of the annular flange 5, a sufficiently wide surrounding seal surface of width S is formed, which in practice is roughly 3 mm wide. In order to open the can, the base portion 3 is peeled off along this seal surface from the annular flange 5 of the cover ring 2. Therefore, in order to peel off the seal surface, the base portion must be provided with a handle, which permits it to be grasped by the fingers in order to initiate the peeling forces. Such a handle is formed by an opening strap or better still by an opening ring, as shown in FIGS. 9 to 12. Such an opening ring 14 has an attachment tab 15, which is attached in the lateral area 3*a* of the base portion 3 on its outer side by heat sealing, gluing or the like. The attachment tab 15 for this purpose, as comparison of FIGS. 9 and 10 with FIGS. 11 and 12 will show, can be of differing types of design and attachment. In the embodiment shown in FIGS. 9 and 10, in the area in which the attachment tab 15 is secured to the base portion 3, a notch line 16 substantially corresponding to the contour of the attachment tab 15 is pressed into the outer side of the base portion. This notch line is formed, before the base portion is stamped out, by corresponding design of the tools. The notch line 16 extends as far as the vicinity of the overlap and seal area of the base portion indicated by a broken line in FIG. 10. If, in order to open the can, the opening ring 14 is pulled upwards in its area 14*a* lying opposite the attachment tab 15, the attachment tab 15 tears the base portion 3 along the notch line 16. As this notch line extends as far as the vicinity of the seal area, the tearing is effected as far as the vicinity of the seal area, and the opening force is introduced in a controlled manner into the seal area. When a pull is exerted on the opening ring 14, then the entire base portion 3 is peeled off from the annular flange 5 along the seal area.

Figure 11:
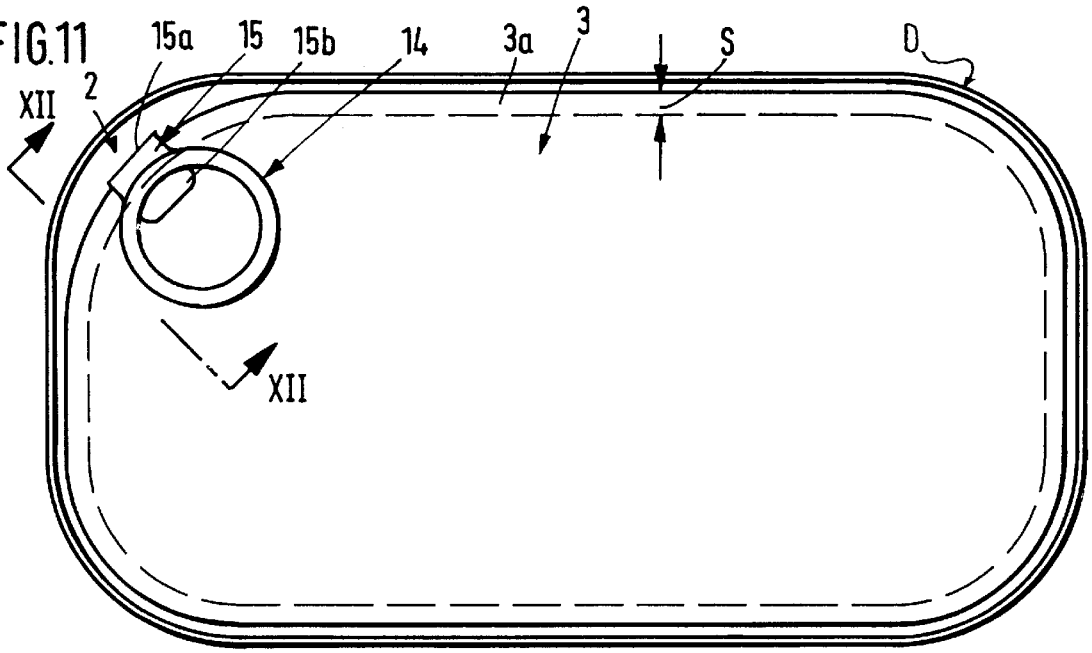
Figure 12:
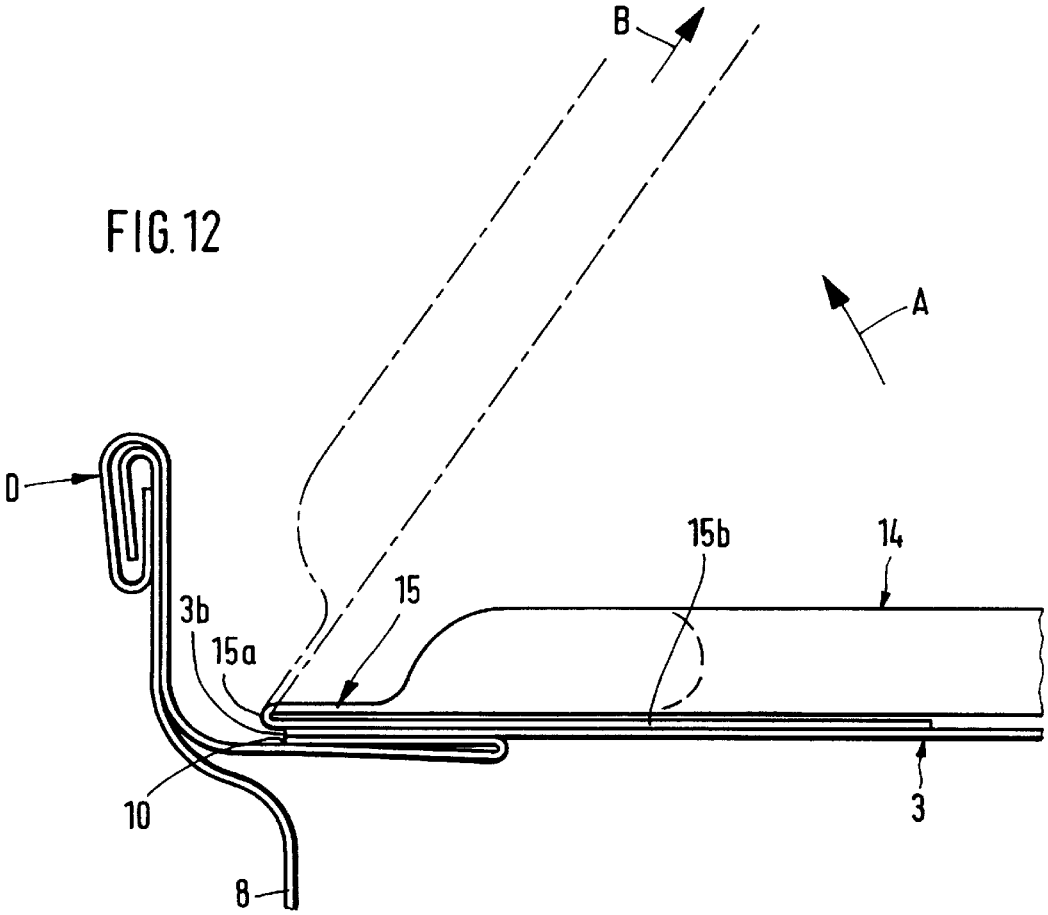
FIG. 12: a cross-section along the lines XII—XII of FIG. 11.

In the embodiment shown in FIGS. 11 and 12, the attachment tab 15 projects outwards from the opening ring 14 and is bent over through 180° along a bending edge 15*a*. Its bent-over free section 15*b* is connected in the lateral area 3*a* of the base portion 3 thereto in such a way that the bending edge 15*a* is located in the vicinity of the outer edge 3*b* of the base portion 3 and extends substantially parallel thereto. In order to open the can, firstly the opening tab is pivoted upwards in the direction of arrow A about the bending edge 15*a* in an upwards direction, and then pulled in the direction B at the opening ring 14. In this way the opening force is firstly introduced to the outer edge 3*b* of the base portion and, during further pulling on the opening ring 14, finally the entire base portion 3 is peeled off along the seal area from the cover ring 2.

The embodiments of the invention in which an exclusive property or privilege is claimed are defined as follows:

1. Method of manufacturing an easily-opened can lid from a coated sheet metal blank, comprising the following steps:

deep-drawing a blank provided on one side with a coating capable of hear-sealing, in order to form an outer rim at the edge of the blank for later formation of a double seam, and in order to form a flat indentation surrounded by the outer rim, with a base portion and a wall portion connecting the latter with the outer rim, said wall portion extending substantially vertically to the base portion, stamping out substantially the entire base portion in the direct vicinity of its transition to the wall portion, in order to form a cover ring whose inner cut edge, resulting from stamping, surrounds an opening, partial rolling of the wall portion in an outward direction in order to form a roll curl whose inner limit surrounds a smaller opening similar to the original opening formed by the stamping, in order to introduce a mutual overlapping of the lateral area of the previously stamped base part with the roll curl, at which the cut edge bears on the outer side of the cover ring, pressing flat the roll curl into the plane of the cover ring, or a plane parallel thereto, in order to form an annular flange suitable for heat-sealing, and in order to enlarge the overlapping, and heat-sealing the stamped out base portion on to the surface of the annular flange lying on the outer side of the cover ring, during flat pressing or after flat pressing of the roll curl.

2. Method according to claim 1, wherein the base portion is offset outwards (i.e. towards the outer side of the lid) relative to the cut edge before rolling.

3. Method according to claim 2, wherein offsetting is effected during stamping by the stamping tool.

4. Method according to claim 1, wherein, in order to form the indentation, a groove with a substantially U-shaped cross-section is shaped by deep-drawing in the sheet metal blank adjacent to the outer rim of the later outer side of the lid said groove having an outer wall portion directly adjoining the outer rim, and an inner wall portion adjoining the base portion, and in that, after stamping of the base portion, the wall portion is rolled.

5. Method according to claim 1, wherein an attachment tab connected to an opening ring or an opening strap is secured to the lateral area of the base portion on the outer side of the base portion.

6. Method according to claim 5, wherein before stamping of the base portion, in the area in which the attachment tab is later to be secured, a notch line substantially corresponding to the contour of the attachment tab is pressed into the outer side of the base portion, said notch line extending into the vicinity of the later overlap and seal area of the base portion.

7. Method of manufacturing an easily-opened can lid from a coated sheet metal blank, comprising the following steps:

deep-drawing a blank provided on one side with a coating capable of heat-sealing, in order to form an outer rim at the edge of the blank for later formation of a double seam, and in order to form a flat indentation surrounded by the outer rim, with a base portion and a wall portion connecting the latter with the outer rim, said wall portion extending substantially vertically to the base portion, stamping out substantially the entire base portion in the direct vicinity of its transition to the wall portion, in order to form a cover ring whose inner cut edge, resulting from stamping, surrounds an opening, partial rolling of the wall portion in an outward direction in order to form a roll curl whose inner limit surrounds a smaller opening similar to the original opening formed by the stamping, in order to introduce a mutual overlapping of the lateral area of the previously stamped base part with the roll curl, at which the cut edge bears on the outer side of the cover ring, pressing flat the roll curl into the plane of the cover ring, or a plane parallel thereto, in order to form an annular flange suitable for heat-sealing, and in order to enlarge the overlapping, and heat-sealing the stamped out base portion on to the surface of the annular flange lying on the outer side of the cover ring, during flat pressing or after flat pressing of the roll curl, wherein, during rolling of the wall portion, adjacent to its cut edge there is formed a retaining groove, open towards the opening, for the edge of the stamped-out base portion.

8. Method of manufacturing an easily-opened can lid from a coated sheet metal blank, comprising the following steps:

deep-drawing a blank provided on one side with a coating capable of heat-sealing, in order to form an outer rim at the edge of the blank for later formation of a double seam, and in order to form a flat indentation surrounded by the outer rim, with a base portion and a wall portion connecting the latter with the outer rim, said wall portion extending substantially vertically to the base portion, stamping out substantially the entire base portion in the direct vicinity of its transition to the wall portion, in order to form a cover ring whose inner cut edge, resulting from stamping, surrounds an opening, partial rolling of the wall portion in an outward direction in order to form a roll curl whose inner limit surrounds a smaller opening similar to the original opening formed by the stamping, in order to introduce a mutual overlapping of the lateral area of the previously stamped base part with the roll curl, at which the cut edge bears on the outer side of the cover ring, pressing flat the roll curl into the plane of the cover ring, or a plane parallel thereto, in order to form an annular flange suitable for heat-sealing, and in order to enlarge the overlapping, and heat-sealing the stamped out base portion on to the surface of the annular flange lying on the outer side of the cover ring, during flat pressing or after flat pressing of the roll curl, wherein during stamping of the base portion, a few narrow connecting webs are left between the base portion and the wall portion, said connecting webs holding the base portion in correct position on the cover ring during transfer to further shaping stations.

* * * * *